United States Patent [19]

Weigel

[11] Patent Number: 4,858,905

[45] Date of Patent: Aug. 22, 1989

[54] DISPENSING DEVICE FOR SHEET MATERIAL

[75] Inventor: Peter Weigel, Borchen-Dörenhagen, Fed. Rep. of Germany

[73] Assignee: Nixdorf Computer AG, Paderborn, Fed. Rep. of Germany

[21] Appl. No.: 162,715

[22] Filed: Mar. 1, 1988

[30] Foreign Application Priority Data

Mar. 3, 1987 [DE] Fed. Rep. of Germany ..... 3706834

[51] Int. Cl.[4] ..... B65H 5/00

[52] U.S. Cl. ..... 271/10; 271/122; 271/125

[58] Field of Search ..... 271/119, 121, 122, 125, 271/126, 272, 10, 182, 104, 137, 124, 167, 188

[56] References Cited

U.S. PATENT DOCUMENTS 3,281,143 10/1966 Mommsen et al. ..... 271/10
4,496,145 1/1985 Fukui ..... 271/122
4,715,597 12/1987 Sakurai ..... 271/122

FOREIGN PATENT DOCUMENTS 2850185 5/1980 Fed. Rep. of Germany .
72538 5/1982 Japan ..... 271/272

*Primary Examiner*—Joseph J. Rolla
*Assistant Examiner*—David H. Bollinger
*Attorney, Agent, or Firm*—Dykema Gossett

[57] ABSTRACT

In a dispensing device for sheet material that includes a draw-off device and a single feed device with at least one draw-off roll, several conveyor rolls (22) arranged side by side with some axial spacing and with mating rolls (24) that are axially offset and are radially adjustable with respect to the conveyor rolls (22), where the mating rolls (24) and at least one of the conveyor rolls (22) that can be driven in the same direction with the former are made of a hard material, a ring-shaped strip (44) made of an elastic deformable material is embedded in the peripheral surface of the conveyor roll (22) that is made of a hard material where the axial width of this ring is smaller than the axial width of the peripheral surface of the conveyor roll (22) and projects radially above the peripheral surface in the unloaded state.

4 Claims, 2 Drawing Sheets

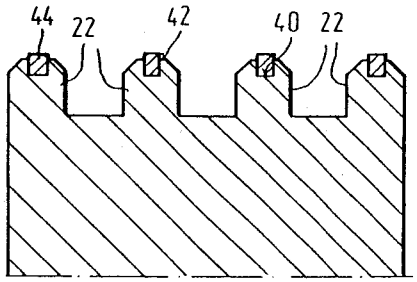
Fig. 3
Fig. 1
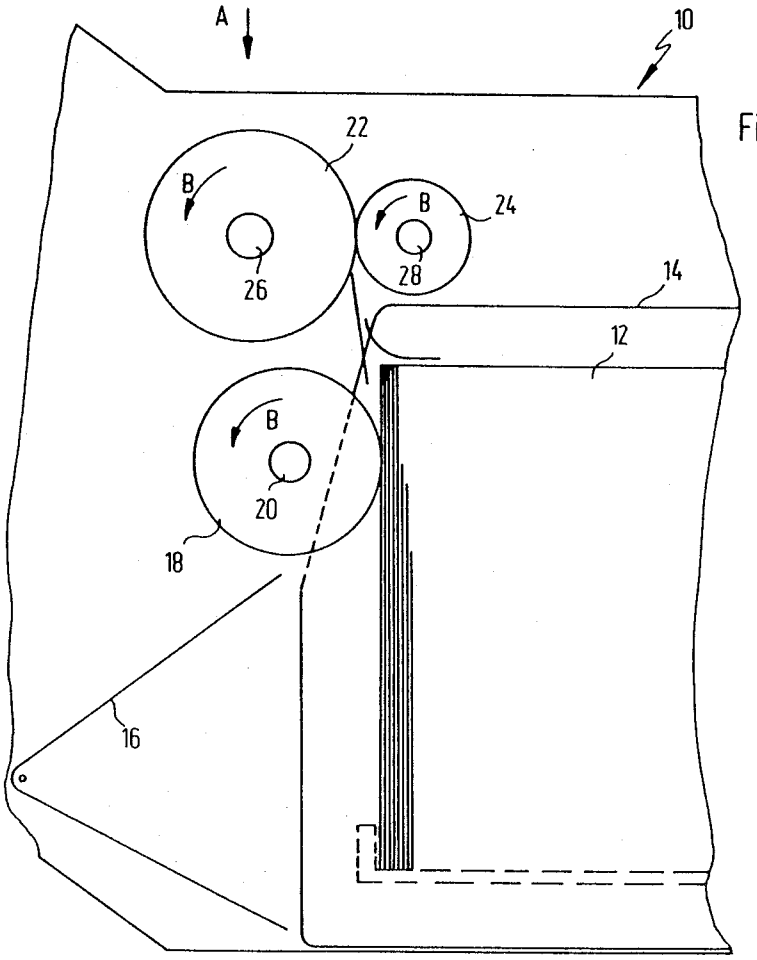

DISPENSING DEVICE FOR SHEET MATERIAL

TECHNICAL FIELD

This invention concerns a dispensing device for sheet material, especially for dispensing currency bills, including a storage container for a stack of sheets and a draw-off and single feed device provided with the storage container with at least one draw-off roll for contacting the stack of sheets, several conveyor rollers arranged side by side with some axial spacing and with mating rolls paired with the conveyor rolls so the mating roll can be adjusted radially with respect to the conveyor rolls and are axially offset in such a way that they can press between two adjacent conveyor rolls, and the rolls on parallel shafts can be driven in the same direction, and the mating rolls and at least one conveyor roll are made of a hard material while the other conveyor rolls are made of an elastic flexible material.

BACKGROUND OF THE INVENTION

A device of the type defined above is known from German Patent No. 2,850,185, for example. In dispensing devices of this type, it is an important object to provide reliable single feed of the sheets of material. This does not generally pose any special problem if sheets of a uniform quality are processed. However, this prerequisite is not met in single feed of paper currency, for example, in two regards. First there is a substantial variation in the grades of paper used in individual currencies, but furthermore the quality of paper currency changes with use. New currency bills are generally relatively smooth and stiff, whereas they develop a rougher surface with use and at the same time become less stiff. However, dispensing devices of the type defined initially must be suitable for all types of paper currency without changing rolls.

In a case of sheets that are cut in stacks, the problem exists in that the sheets stick together at their cut edges. Thus several sheets at a time are pulled off by the draw-off rolls and conveyed into the gap between the conveyor rolls and the mating rolls. If the conveyor rolls and/or mating rolls are made exclusively of soft material, there is a danger that this material will give and allow the entire bundle to be conveyed through the gap. To eliminate this problem, it has already been proposed in German Patent No. 2,850,185 that the mating rolls and at least one of the conveyor rolls should be made of a hard material with a Shore hardness of 92 to 95. Although this solution has yielded good results, there have been repeated problems in single feed of sheets in dispensing paper currency or sheets of a certain quality in individual cases.

SUMMARY OF THE INVENTION

This invention is based on the problem of further improving a dispensing device of the type defined initially such that a reliable single feed of sheets is assured even when there are extreme differences in paper quality.

This problem is solved according to this invention by the fact that a ring made of an elastic deformable material is embedded in the peripheral surface of the conveyor roll that is made of hard material such that the axial width of this ring is smaller than the axial width of the peripheral surface of the conveyor roll, and in the unloaded state it projects radially beyond the peripheral surface.

In the known prior art, the feed of sheets entering the roll gap is accomplished mainly through the conveyor rolls which are made of an elastic flexible material. However, these rolls in particular have a tendency to give to the counterpressure of the mating rolls required for single feed so it often happens with sheets or paper currency of a certain paper quality that a pack of several sheets slips through the roll gap at the same time. This possibility is eliminated by the solution according to this invention, because with it the soft material that has a high coefficient of friction and thus has a high entraining effect is located directly in the surface of the hard conveyor rolls. If a bundle of sheets attempts to enter the roll gap between the conveyor rolls and mating rolls, the soft material is compressed slightly but then the hard material of the conveyor rolls which does not give prevents the penetration of a package of several sheets into the roll gap and yet at the same time the entraining effect of the soft material is maintained. In this way, a reliable separation even of sheets adhering rather tightly to each other is achieved, and this assures that only one sheet is fed through the roll gap into the remaining conveyance path for the sheets. In order to achieve the most uniform possible single feed effect over the entire axial length of the roll gap, it may be expedient to provide soft and hard conveyor rolls in alternation axially side by side. For manufacturing reasons, however, it is expedient and possible without resulting in any disadvantages to combine several conveyor rolls of the same properties in groups and to arrange the groups of soft conveyor rolls and the groups of hard conveyor rolls in alternating sequence axially side by side.

The height of the radial projection of the ring-shaped strip over the surface of the hard conveyor rolls will depend to a certain extent on the type of soft material used. However, a radial projection of about 0.1 to 0.2 mm has proven expedient. In comparison with the hard material of the conveyor rolls which has a Shore hardness of at least 92 to 95, the elastically deformable material of the ring should have a Shore hardness of about 75. One suitable material is a polyurethane elastomer distributed under the brand name Vulkollan.

The hard conveyor rolls may be made of metal and may have a circumferential groove in which the ring is embedded.

Additional features and advantages of this invention will be apparent from the following description which explains the invention on the basis of a practical example with reference to the accompanying figures.

BRIEF DESCRIPTION OF THE DRAWINGS

FIG. 1 is a schematic partial side view of a single feed module with a storage container for a stack of sheet and the essential elements of a draw-off device.

FIG. 3 is a section along line III—III in FIG. 2.

DETAILED DESCRIPTION OF THE PREFERRED EMBODIMENT

Figure 2:
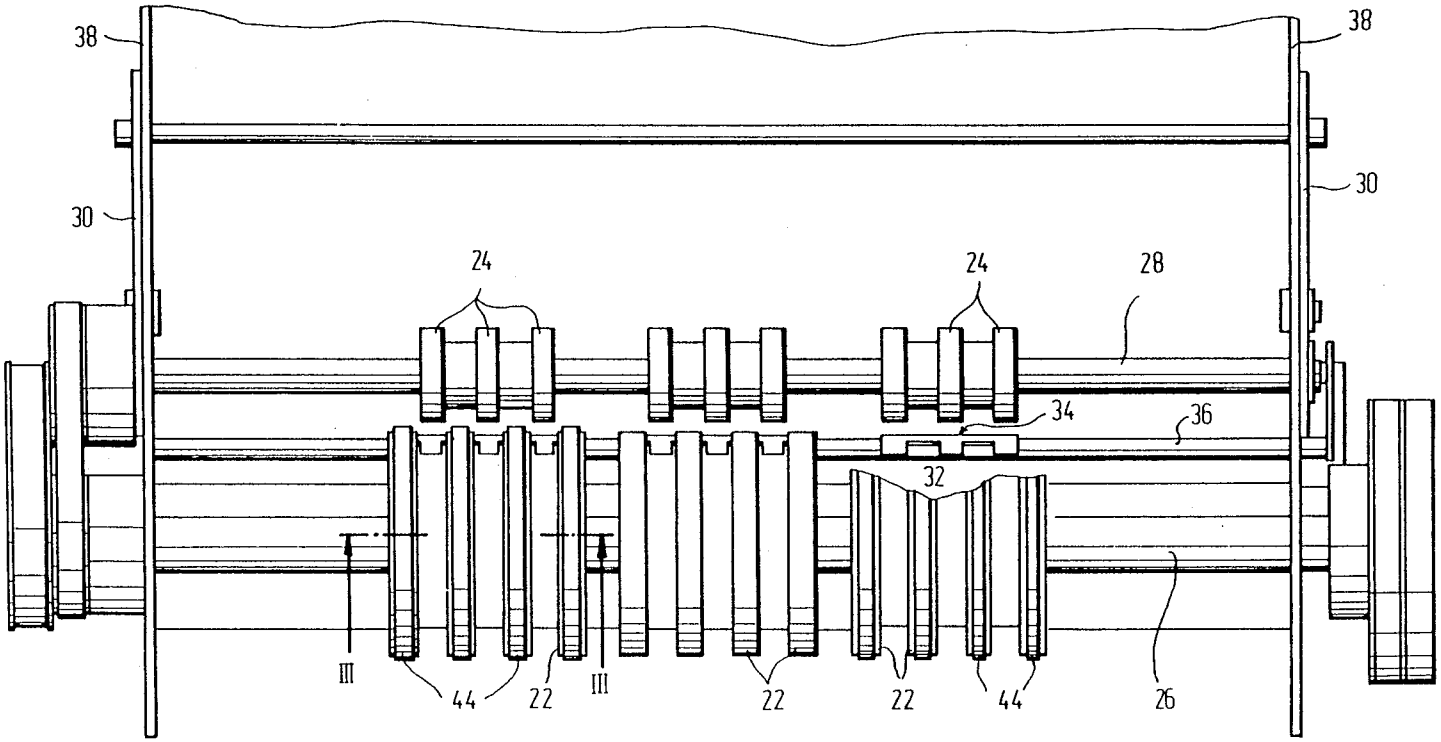
FIG. 2 is a top view of the draw-off device in the direction of arrow A in FIG. 1.

FIG. 1 shows a single feed module designated in general at 10 consisting of a cube-shaped frame into which a cassette 14 holding a stack of sheets 12 is inserted. In this state, a flap 16 of cassette 14 is opened, so draw-off rolls 18 of a draw-off device of the single feed module 10 can press against the front sheet of the stack 12 in cassette 14. Stack 12 is placed under pretension by a device (not shown) in the direction of draw-off rolls 18 so the sheets of stack 12 are constantly pressed against draw-off rolls 18 with a certain pretension. Draw-off rolls 18 are mounted on a shaft 20 that can be driven in the direction of arrow B by a drive mechanism (not shown).

Draw-off rolls 18 convey the sheet of stack 12 that is in contact with the draw-off rolls or optionally the draw-off rolls may also convey several sheets sticking together in the direction of a roll gap between conveyor rolls 22 and mating rolls 24 that are mounted on shafts 26 and 28 parallel to shaft 20 and can be driven counterclockwise in the same direction as draw-off rolls 18. Conveyor rolls 22 have the function of conveying the sheet with which they are in contact upward through the roll gap in FIG. 1, while the mating rolls should prevent more than one sheet from passing through the roll gap between conveyor rolls 22 and mating rolls 24. Mating rolls 24 can be driven together with either the conveyor rolls or the draw-off rolls 18.

As FIG. 2 shows in this practical example, the conveyor rolls 22 are grouped together in three groups where the conveyor rolls 22 of each group are joined together as one piece. Likewise, the mating rolls 24 are grouped together in three groups of rolls joined together in one piece. Mating rolls 24 are offset axially with respect to conveyor rolls 22 in such a way that they are opposite the interspaces between conveyor rolls 22. The shaft of mating rolls 24 is mounted in rocker arms 30 so the mating rolls 24 can press into the interspaces between conveyor rolls 22, as indicated by the dash-dot lines. Furthermore, the fingers 32 of a guide plate 34 mounted with a shaft 36 so it can pivot in the side walls 38 of the single feed module 10 also reach into the interspaces between the conveyor rolls 22.

The two outer groups of conveyor rolls 22 of the three roll groups illustrated in FIG. 2 are each made of metal, e.g., aluminum, and are provided with a peripheral ring groove 40 that is narrower than the respective peripheral surface 42 of conveyor rolls 22 (FIG. 3). A ring 44 of elastically deformable material such as a polyurethane elastomer is embedded in ring groove 40, where this strip in the unloaded state projects about 0.1 to about 0.2 mm radially above the peripheral surface 42 of the respective conveyor roll 22. This material which has a Shore hardness of about 75 has a high coefficient of friction and thus assures active conveyance of the sheets entering the gap between conveyor rolls 22 and mating rolls 24.

The middle group of conveyor rolls is made of an elastic flexible material, preferably a material with a cellular or porous surface, e.g., cellular polyurethane with a density of 0.7 g/cm$^3$.

In the practical example illustrated here, the conveyor rolls of each roll group are grouped together in one piece so they form a conveyor roll with a comb-like profile. However, each of these rolls could also be composed of individual conveyor rolls with spacer rings or individual stepped conveyor rolls.

When operation of the draw-off module is begun, the distance between conveyor rolls 22 and mating rolls 24, i.e., the width of the roll gap, is adjusted according to the thickness and quality of the sheets to be drawn off. The adjustment takes place by pivoting movement of the shaft 28 of the mating roll 24 mounted in the rocker arms 30. An adjustment mechanism suitable for this purpose is described in German Patent No. 2,850,185. The roll gap is adjusted in such a way that only one sheet at a time can pass through the gap. If a pack of several sheets sticking together is drawn off by the draw-off rolls 18 and conveyed in the direction of the roll gap between conveyor rolls 22 and mating rolls 24, then only the sheet of the peak facing the conveyor rolls 22 will be moved and conveyed through the roll gap, while the remaining sheets will be retained by mating rolls 24. When a pack of sheets attempts to enter the roll gap, a certain radial pressure develops on conveyor rolls 22, causing the middle conveyor rolls made of the elastic flexible material to give, but the outer conveyor rolls that are made of metal do not give. If the hard conveyor rolls have a completely hard smooth peripheral surface, then in this case it is possible to prevent the simultaneous passage of several sheets through the roll gap although the frictional forces exerted by the conveyor rolls on the sheet facing them are not sufficient to overcome the friction grip between the adjacent sheets and convey this single sheet through the roll gap, because the conveyor rolls that are made of a soft material are limited to the entrainment forces exerted on the sheets because of the flexibility of the material.

This problem is overcome through the inserted strips 44 embedded in the hard conveyor rolls 22. Due to these strips, the conveyor rolls 22 can exert high frictional forces on the passing sheets precisely in the area of the roll gap, where the sheet passing through at that moment is pressed securely against the rolls because of the inflexibility of the roll material. As FIG. 2 shows, a passing sheet is put under tension by the mating rolls 24 pressing between two conveyor rolls 22 so the sheet is pressed around the peripheral surfaces of conveyor rolls 22 and thus a reliable friction grip develops between strips 44 and the sheet that is to be conveyed. The fact that high conveyance forces can be transferred to the sheet that is to be conveyed in this way again makes it possible to adjust the roll gap so it is relatively narrow so a single feed is assured even with sheet material that is difficult to handle.

I claim:

1. A device for dispensing sheet material comprising:

a sheet storage container having a stack of sheets;

a driver draw-off roller mounted on an axis perpendicular to said stack;

bias means maintaining said stack in contact with said draw-off roller, such that rotation of said draw-off roller removing sheet from said stack;

a second roller assembly, said draw-off roller sending the removed sheets to said second roller assembly;

said second roller assembly comprising a conveyor roll portion and a mating roll portion mounted adjacent to each other, both mounted on axes parallel to said axis of said draw-off roller and the mounting of said conveyor roll portion and said mating roll portion being such that a small gap exists between their radially outer peripheries;

said draw-off roller sending the removed sheets into said gap;

said conveyor roll comprising at least three separate sections spaced axially along said conveyor roll mounting axis, there being at least one central section and two outer sections, said central section being formed of a plastic material and said two outer portions being formed of a metal; and said two outer sections each have a circumferential groove formed at their periphery and a ring shaped strip of elastically deformable material is embedded therein, the axial extent of said groove being less than the axial extent of said outer sections.

2. A device as recited in claim 1 wherein there are only three of said sections and only one of said central sections.

3. A device as recited in claim 2 wherein said mating roll comprises at least three separate sections spaced axially along said mating roll mounting axis.

4. A device as recited in claim 1 wherein all of said at least three sections of said conveyor roll have an equal diameter and said ring-shaped strip extends radially outwardly from said groove to a greater radial extent than the equal diameter.

* * * * *